US006402533B1

(12) United States Patent
Fan Wong

(10) Patent No.: US 6,402,533 B1
(45) Date of Patent: Jun. 11, 2002

(54) DECORATIVE LIGHT PLUG

(76) Inventor: Tsui-Tuan Fan Wong, 15th Fl.-D, No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 09/784,776

(22) Filed: Feb. 15, 2001

(51) Int. Cl.[7] ..... H01R 13/44; H01R 33/00
(52) U.S. Cl. ..... 439/135; 362/226
(58) Field of Search ..... 439/135, 136, 439/142, 146, 147, 680; 362/226, 216, 260, 378, 400

(56) References Cited

U.S. PATENT DOCUMENTS 4,981,439 A * 1/1991 Piedmont ..... 439/135
5,860,730 A * 1/1999 Hesprich ..... 362/226
6,039,460 A * 3/2000 Ng et al. ..... 362/226
6,083,016 A * 7/2000 Waywick, Sr. ..... 439/135
6,142,805 A * 11/2000 Gray et al. ..... 439/206

* cited by examiner

*Primary Examiner*—Hien Vu
(74) *Attorney, Agent, or Firm*—Alan Kamrath; Rider, Bennett, Egan & Arundel, LLP

(57) ABSTRACT

A decorative light plug has an female connector integrally formed on the decorative light and having a flange formed on an outer periphery of the female connector and a cover having a blind hole defined to enclose a distal end of the decorative light and a pair of L-shaped keyways formed to correspond to a pair of keys formed on the outer periphery of the female connector. After the distal end of the decorative light is inserted into the blind hole of the cover, rotation of the cover will secure the engagement between the cover and the decorative light.

1 Claim, 3 Drawing Sheets

DECORATIVE LIGHT PLUG

BACKGROUND OF THE INVENTION

1. Field of the Invention

The present invention relates to a decorative light plug, and more particularly to a decorative light plug detachably connected with a distal end of the decorative light so as to protect the distal end of the decorative light from damage.

2. Description of Related Art

A kind of light is made by connecting numerous small light sources in series and coating them with flexible and transparent plastic material so that the light sends out soft light and provides a decorative effect. Since the light sources are connected in parallel, it is important to provide a secure connection between adjacent bulbs. With reference to FIG. 3, a conventional light plug (4) is integrally formed on a distal end of the decorative light to protect the pins (not shown) inside the decorative light from damage. When the decorative light of this kind is to be extended, the user will have to cut off the plug (4) and reconnect the distal end of the decorative light with a distal end of another decorative light, which is not only troublesome, but also a waste of material.

To overcome the shortcomings, the present invention tends to provide an improved decorative light plug to mitigate and obviate the aforementioned problems.

SUMMARY OF THE INVENTION

The primary objective of the invention is to provide an improved decorative light with a plug detachably connected with the decorative light. The plug has a collar slidably retained on the decorative light and a cover detachably connected to the collar, such that when the decorative light is not in use, the cover is able to connect with the collar to protect the distal end of the decorative light from damage.

Other objects, advantages and novel features of the invention will become more apparent from the following detailed description when taken in conjunction with the accompanying drawings.

DETAILED DESCRIPTION OF PREFERRED EMBODIMENT

Figure 1:
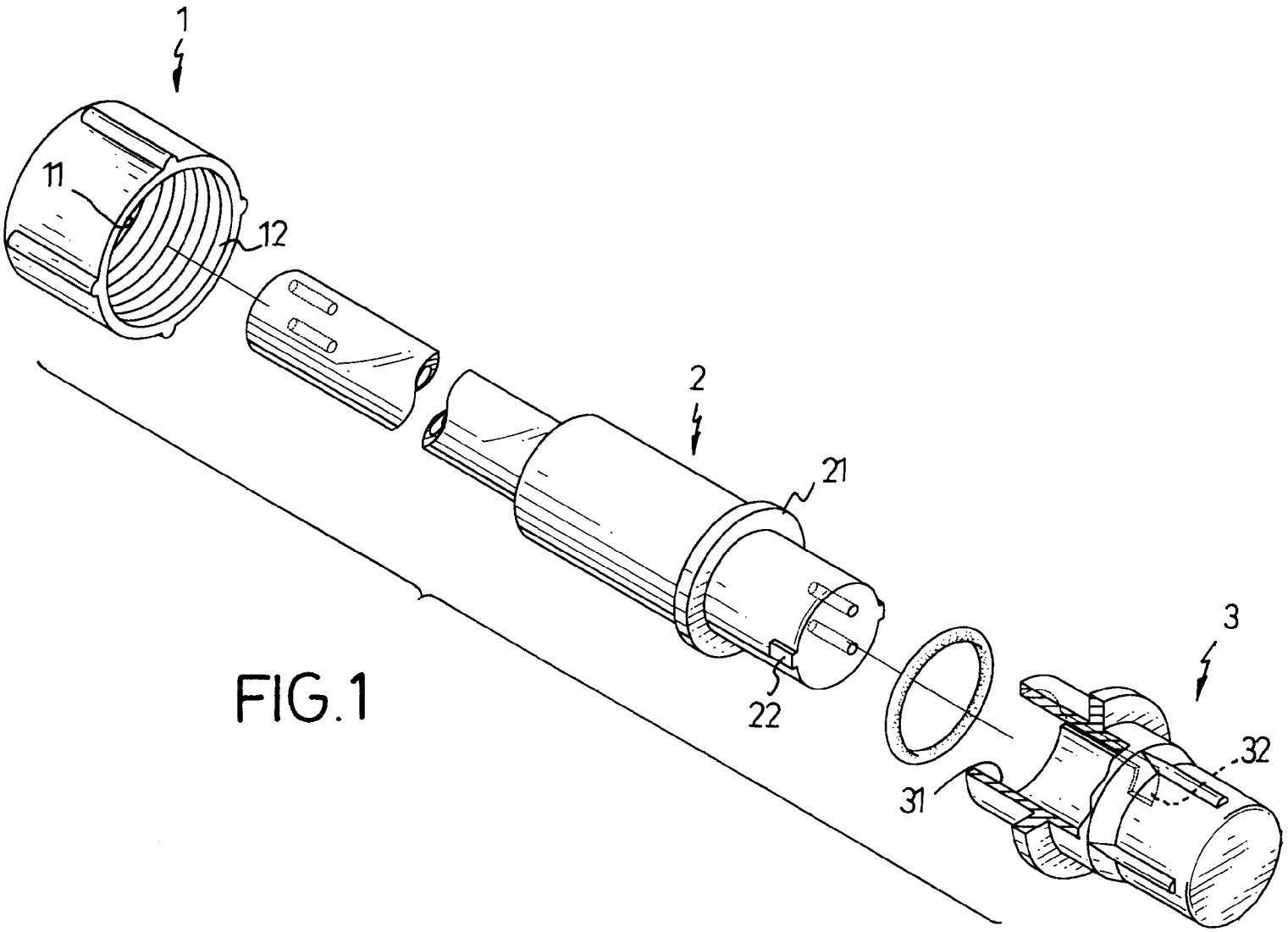
FIG. 1 is an exploded perspective view of the decorative light plug in accordance with the present invention together with the decorative light.
Figure 2:
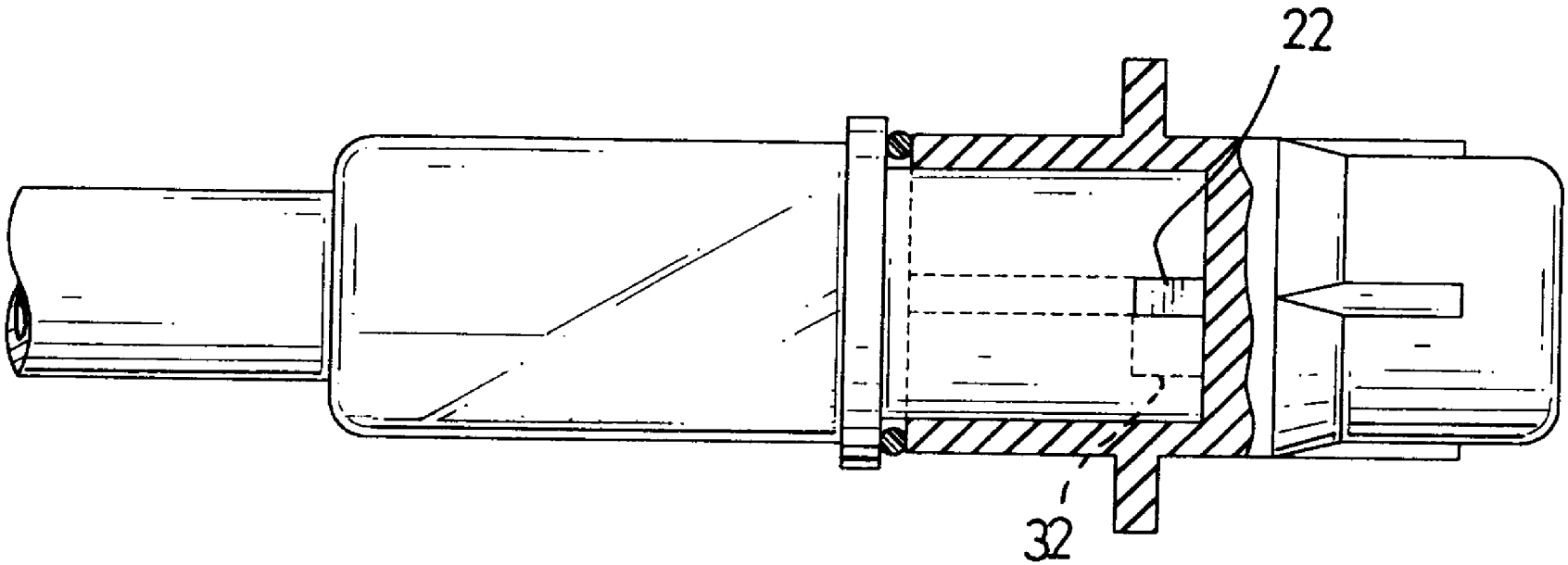
FIG. 2 is a side view in partial cross section of the decorative light plug in FIG. 1 showing the engagement between the cover and the collar.
Figure 3:
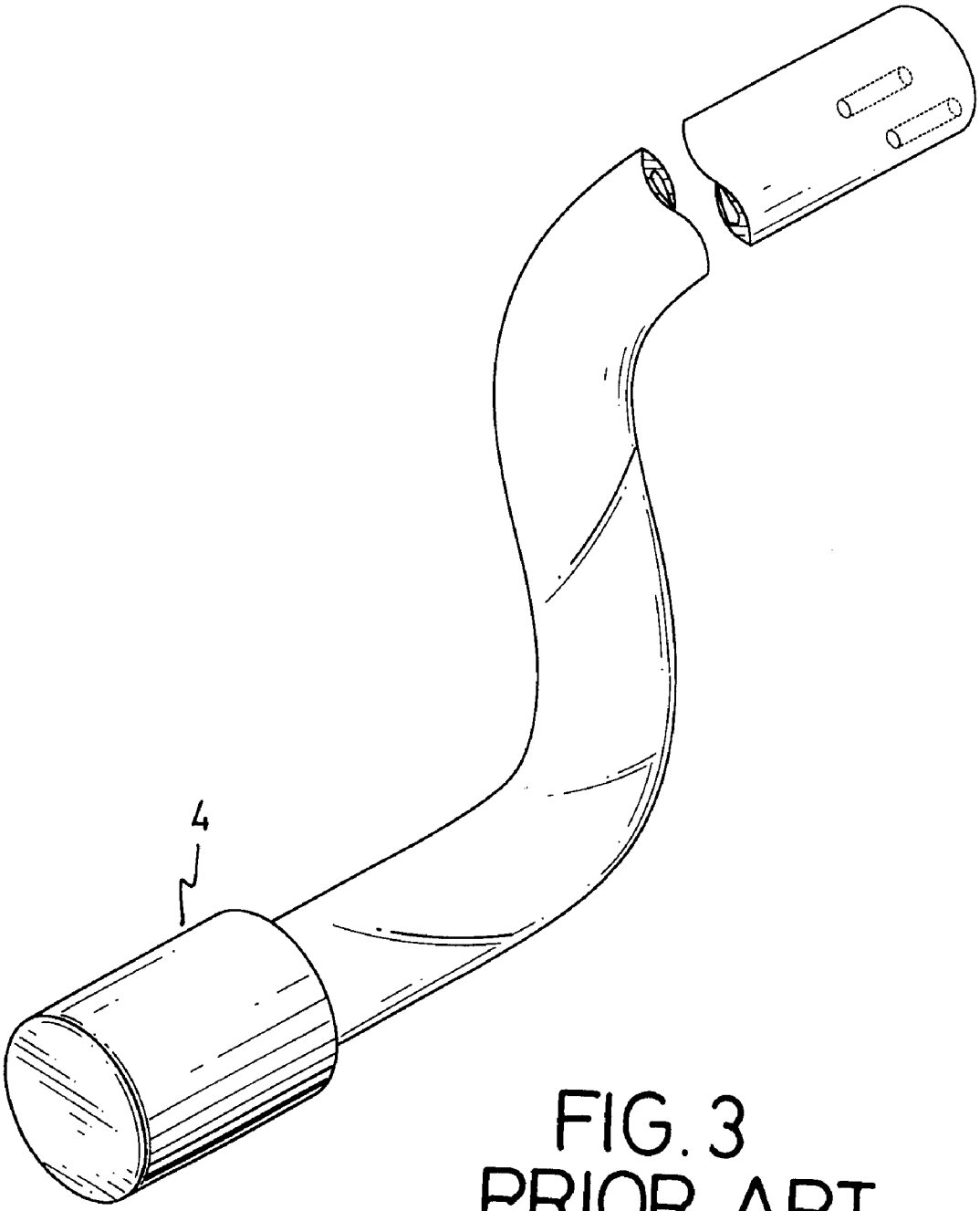
FIG. 3 PRIOR ART
FIG. 3 is a perspective view of a conventional decorative light plug.

With reference to FIG. 1, the decorative light plug has a collar (1), a female connector (2) and a cover (3).

The collar (1) has a through hole (11) defined through the collar (1) and inner thread (12). The collar is slidably retained on the decorative light.

The female connector (2) is integrally formed on a distal end of the decorative light and has a flange (21) formed on an outer periphery of the female connector (2) and a pair of keys (22) formed on opposite sides of the distal end of the female connector (2).

The cover (3) has a blind hole (31) defined to enclose the distal end of the decorative light and a pair of L-shaped keyways (32) formed on an inner face defining the blind hole (31) and corresponding to the pair of opposed keys (22).

When the decorative light of the invention is not in use, the user may use the cover (3) to engage with the decorative light by inserting the keys into the corresponding L-shaped keyways (32). After the keys (22) are completely inserted into the keyways (32), the user may rotate the cover (3) to hold the keys (22) inside L-shaped keyways (32) and therefore secure the engagement between the cover (3) and the decorative light. Accordingly, the distal end of the decorative light is protected by the cover (3).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug for a decorative light having a distal end comprising:

a female connector adapted to be integrally formed on the distal end of the decorative light, with the female connector having a distal end, an annular flange extending from an outer periphery of the female connector and axially spaced from the distal end of the female connector, and a pair of keys formed on opposite sides of the outer periphery of the distal end of the female connector axially spaced from the annular flange;

an annular seal received on the distal end of the female connector and abutting with the flange;

a cover having a blind hole receiving the distal end of the female connector and defined to enclose the distal end of the decorative light, with the cover including a pair of L-shaped keyways formed on an inner face defining the blind hole and corresponding to the pair of keys; and a collar having a through hole for receiving the female connector and adapted to abut the flange opposite the annular seal, said collar further having an inner thread, whereby after the female connector is inserted into the blind hole with the keys in the keyways, rotation of the cover will secure the engagement between the cover and the decorative light to sandwich the annular seal between the flange and the cover such that when the decorative light is not in use the distal end of the decorative light is protected from damage.

* * * * *